US008136322B2

(12) United States Patent
Shadwell et al.

(10) Patent No.: US 8,136,322 B2
(45) Date of Patent: Mar. 20, 2012

(54) COMPOSITE SHINGLE

(75) Inventors: Peter Shadwell, Carl Junction, MO (US); Brandon Lee Brummett, Lamar, MO (US)

(73) Assignee: Tamko Building Products, Inc., Joplin, MO (US)

( * ) Notice: Subject to any disclaimer, the term of this patent is extended or adjusted under 35 U.S.C. 154(b) by 0 days.

(21) Appl. No.: 12/546,787

(22) Filed: Aug. 25, 2009

(65) Prior Publication Data

US 2011/0047894 A1 Mar. 3, 2011

(51) Int. Cl.
*E04D 1/00* (2006.01)
*E04D 1/34* (2006.01)

(52) U.S. Cl. ..... 52/518; 52/519; 52/526; 52/550; 52/553; 52/554; 52/557

(58) Field of Classification Search ..... 52/518, 52/519, 526, 550, 553, 554, 557, 558, 560
See application file for complete search history.

(56) References Cited

U.S. PATENT DOCUMENTS

| | | | | |
|---|---|---|---|---|
| 511,385 | A | 12/1893 | White | |
| 1,404,483 | A | 1/1922 | Scharwath et al. | |
| 1,860,899 | A | 5/1932 | Miller | |
| 2,168,218 | A * | 8/1939 | Kirschbraun | 52/560 |
| 2,188,090 | A | 1/1940 | Young | |
| 2,235,212 | A | 3/1941 | Herscovitz | |
| 2,308,766 | A | 1/1943 | Martinus | |
| 3,030,234 | A | 4/1962 | McClinton | |
| 3,332,193 | A | 7/1967 | Elmendorf | |
| 3,344,011 | A | 9/1967 | Goozner | |
| 3,507,079 | A | 4/1970 | George | |
| 3,579,940 | A | 5/1971 | Greenleaf | |
| 3,608,261 | A | 9/1971 | French et al. | |
| 3,618,274 | A | 11/1971 | Vickerman | |
| 3,783,570 | A | 1/1974 | Storch | |
| 3,830,687 | A | 8/1974 | Re et al. | |
| 3,847,865 | A | 11/1974 | Duggins | |
| 3,899,855 | A | 8/1975 | Gadsby | |
| 3,903,340 | A | 9/1975 | Shepherd | |
| 3,943,677 | A | 3/1976 | Carothers | |
| 4,001,997 | A | 1/1977 | Saltzman | |
| 4,015,391 | A | 4/1977 | Epstein et al. | |
| 4,015,392 | A | 4/1977 | Eaton | |
| 4,028,450 | A | 6/1977 | Gould | |
| 4,128,369 | A | 12/1978 | Kemerer et al. | |
| 4,130,974 | A | 12/1978 | Chalmers et al. | |

(Continued)

FOREIGN PATENT DOCUMENTS

AU 6292986 3/1987

(Continued)

*Primary Examiner* — Mark Wendell
(74) *Attorney, Agent, or Firm* — Husch Blackwell LLP

(57) ABSTRACT

A composite shingle having unitary construction is presented that includes a body shell, a plurality of longitudinal ribs, and a plurality of rib stiffeners. The present composite shingle may also include transverse ribs, a depressed nailing zone, nailing zone ribs, and/or at least one alignment aid. The plurality of rib stiffeners may include a material saving profile. Further, the dimensions of the composite shingle more closely resemble true slate and shake shingles and at least a portion of the outside face of composite shingle may be textured to resemble slate or wood shake shingles.
A plurality of assembled composite shingles of the present invention is also claimed as part of this invention. Finally, a method of applying multiple courses of shingles on a roof including the composite shingle of the present invention is presented.

18 Claims, 4 Drawing Sheets

U.S. PATENT DOCUMENTS

| | | | | | |
|---|---|---|---|---|---|
| 4,267,222 | A | | 5/1981 | Sanders | |
| 4,279,106 | A | | 7/1981 | Gleason et al. | |
| 4,288,959 | A | | 9/1981 | Murdock | |
| 4,290,248 | A | | 9/1981 | Kemerer et al. | |
| 4,307,552 | A | | 12/1981 | Votte | |
| 4,366,197 | A | | 12/1982 | Hanlon et al. | |
| 4,405,680 | A | | 9/1983 | Hansen | |
| 4,506,050 | A | | 3/1985 | Hergenrother et al. | |
| 4,514,947 | A | | 5/1985 | Grail | |
| 4,592,185 | A | | 6/1986 | Lynch et al. | |
| 4,680,911 | A | | 7/1987 | Davis et al. | |
| 4,760,679 | A | | 8/1988 | Thompson | |
| 4,765,113 | A | | 8/1988 | Jong | |
| 4,903,445 | A | * | 2/1990 | Mankowski | 52/199 |
| 4,907,499 | A | * | 3/1990 | James | 454/365 |
| 4,982,543 | A | | 1/1991 | Boyd | |
| 5,048,255 | A | | 9/1991 | Gonzales | |
| 5,070,771 | A | * | 12/1991 | Mankowski | 454/275 |
| 5,076,037 | A | | 12/1991 | Crick et al. | |
| 5,295,339 | A | | 3/1994 | Manner | |
| 5,305,569 | A | | 4/1994 | Malmquist et al. | |
| 5,458,538 | A | * | 10/1995 | MacLeod et al. | 454/365 |
| 5,575,127 | A | | 11/1996 | O'Neal | |
| 5,615,523 | A | * | 4/1997 | Wells et al. | 52/98 |
| 5,711,126 | A | * | 1/1998 | Wells | 52/519 |
| 5,729,947 | A | | 3/1998 | Dawes | |
| 5,791,112 | A | | 8/1998 | Plum | |
| 5,902,683 | A | | 5/1999 | Sieloff | |
| 5,946,877 | A | | 9/1999 | Gallinat et al. | |
| 5,992,116 | A | | 11/1999 | Ternes et al. | |
| 6,112,492 | A | * | 9/2000 | Wells et al. | 52/558 |
| 6,164,034 | A | * | 12/2000 | Roetheli et al. | 52/560 |
| 6,178,703 | B1 | | 1/2001 | Noone et al. | |
| 6,233,895 | B1 | * | 5/2001 | Evans et al. | 52/518 |
| 6,338,230 | B1 | | 1/2002 | Davey | |
| 6,530,189 | B2 | * | 3/2003 | Freshwater et al. | 52/553 |
| 6,972,149 | B2 | | 12/2005 | Kuipers et al. | |
| 7,178,301 | B2 | | 2/2007 | Albright | |
| 7,331,150 | B2 | * | 2/2008 | Martinique | 52/520 |
| 7,587,864 | B2 | * | 9/2009 | McCaskill et al. | 52/173.3 |
| 2002/0078651 | A1 | * | 6/2002 | Freshwater et al. | 52/553 |
| 2002/0092256 | A1 | | 7/2002 | Hendrickson et al. | |
| 2004/0148895 | A1 | | 8/2004 | Jolitz et al. | |
| 2005/0072092 | A1 | | 4/2005 | Williams | |
| 2005/0257465 | A1 | | 11/2005 | Felton | |
| 2006/0026908 | A1 | | 2/2006 | Gregori et al. | |
| 2006/0101766 | A1 | | 5/2006 | Jolitz et al. | |
| 2006/0130419 | A1 | | 6/2006 | Bowman | |
| 2007/0011966 | A1 | * | 1/2007 | Justice et al. | 52/309.1 |
| 2007/0022692 | A1 | | 2/2007 | Friedman et al. | |
| 2008/0034699 | A1 | | 2/2008 | Shadwell et al. | |
| 2009/0100779 | A1 | | 4/2009 | Cluthe | |
| 2009/0173031 | A1 | * | 7/2009 | Martinique et al. | 52/553 |

FOREIGN PATENT DOCUMENTS

| | | | |
|---|---|---|---|
| DE | 3402740 | A1 | 8/1985 |
| DE | 4122441 | A1 | 4/1992 |
| DE | 19628322 | A1 | 1/1997 |
| EP | 0020102 | A1 | 12/1980 |
| EP | 1445393 | A1 | 8/2004 |
| FR | 2526015 | | 11/1983 |
| FR | 2534958 | | 4/1984 |
| GB | 2041959 | A | 9/1980 |
| GB | 2129002 | A | 5/1984 |
| WO | 9409223 | A2 | 4/1994 |
| WO | 2006092267 | A1 | 9/2006 |

* cited by examiner

COMPOSITE SHINGLE

CROSS-REFERENCE TO RELATED APPLICATIONS

None

BACKGROUND OF THE INVENTION

The use of natural-appearing materials such as slate or wood shake for composite shingles is a very established practice in building construction. These natural materials are coveted for their appearance and material properties. However, the use of natural materials often has drawbacks that make them less desirable and uneconomical for many applications in modern building construction. Natural slate is coveted for its appearance and durability; however, slate is a very heavy building material with high material and installation costs. The material cost for slate shingles is much greater than the standard asphalt shingles used in most residential construction and its use in certain applications is nearly cost prohibitive. In addition to the higher material price, slate shingles have high installation costs because the shingles must be hand nailed due to the tendency of slate to chip or split under the impact of a nail driven by a pneumatic nail gun. To further add to its disadvantages, slate shingles are much heavier than asphalt shingles. Traditional roof construction may not always be adequate to support the weight of slate shingles; as a result, the structure supporting a slate roof must be stronger to accommodate the increased loads. The increased design load associated with slate shingles ultimately increases entire structure costs as the extra load in the roof must be carried all the way down to the foundations.

Wood shake shingles are similar in weight to common asphalt shingles and do not require increased structure costs; however, wood shingles also have some competitive drawbacks in modern construction. Wood shingles do not have an equivalent life span to asphalt shingles; thus, they need to be replaced much sooner. Further, wood shingles are typically more expensive than asphalt shingles thereby increasing the up front material costs. Wood shingles without sufficient sun exposure are subject to the growth of moss and subsequent rot. Wood shingles also absorb water which results in a tendency to curl and not remain flat on the roof. Wood shingle roofs require frequent "conditioning" wherein rotten shingles are identified and replaced. All of these factors result in increased maintenance costs. Further, wood shingles do not have the fire resistance of asphalt shingles and, in fact, may create a fire hazard as wood shingles are often dry and can actually accelerate a fire if an errant airborne cinder lands on the roof.

Because of the aesthetic appeal of slate and wooden shake shingles, light weight composite shingles made to resemble slate and wooden shake shingles have been developed. Advancements in composite materials have made it possible to manufacture composite shingles that are colored and textured to realistically imitate slate or wood shake shingles. Composite shingles have many advantages over shingles made from natural materials. Composite shingles are lighter in weight and allow a homeowner to obtain the look of slate while maintaining the structural load and framing requirements for a roof with traditional asphalt shingles. Composite shingles will not rot and often have at least a fifty-year life span resulting in low maintenance costs during a roofs life span. Some composite shingles can be installed using a pneumatic nail gun to reduce installation costs. For someone seeking the look of a slate roof, without the associated high cost of materials and installation, composite shingles have great appeal. Likewise, a consumer desiring the look of wooden shake shingles but with lower maintenance costs and increased life span, composite roof shingles have great appeal.

As the demand for composite shingles has increased, many improvements have been made to increase the performance of previous generations of composite shingles. Technologies improving the manufacturing efficiency allow composite shingles to be made with less material. In addition, alignment aids, such as laying lines, scales and spacing nibs, increase the efficiency of installation. However, known composite shingles still have performance defects. For example, when shingles include a cavity under the top surface to achieve a greater, more realistic height while still maintaining a low shingle weight, the top surface often deforms when the composite shingles sit in the sun for prolonged periods of time, thereby creating sag in the middle of the shingle or between the surface supports. Support rails are often added lengthwise within the cavity under the top surface for support in an attempt to remediate this problem; however, while support rails helped reduce the sag in the middle previously experienced, sag between the support rails is still present. In addition, by only including lengthwise support rails, the shingle is still vulnerable to buckling upon application of an uplift force load due to wind loads. In an attempt to adequately resist uplift forces, these rails must be thick to prevent buckling which increases the amount of material required and thus the overall weight of the shingle.

A need exists to increase the performance and efficiency of the structural design of composite shingles with a thick butt end and a formed cavity below the top surface all the while meeting the manufacturing and material constraints of the industry. Improvements of the present invention reduce or maintain the amount of material used in manufacture while simultaneously maintaining or increasing the performance of composite shingles.

SUMMARY OF THE INVENTION

The present invention is generally directed toward a thick butt end composite shingle including a body shell including a top surface, a bottom surface, a butt end wall, a first side wall, second side wall, a tab portion and a lap portion. A portion of the top surface of the body shell may be textured to resemble slate or wood shake shingles. The butt end wall includes a height that creates a shingle profile to more closely resemble natural slate or shake shingles. The first side wall and second side wall generally taper from a greater height at the butt end to a lesser height at the top end. The longitudinal ribs generally extend downward from the bottom surface of the body shell to a common plane. A plurality of rib stiffeners are provided and also extend from the bottom surface of the body shell to the common plane. Further, the rib stiffeners are generally integral to the longitudinal ribs and laterally reinforce the longitudinal ribs at intersection points along the length of the longitudinal ribs.

The rib stiffeners may include a material saving profile having a smaller depth in the mid portion of the stiffener than at the ends, for example, a notched "V" or arched profile. This material saving profile still provides the necessary force transfer and stiffening properties, as well as reduces the amount of material required to manufacture the composite shingle. Generally, rib stiffeners have an orientation with respect to the longitudinal ribs having an angle of incidence less than ninety degrees. The rib stiffeners may be positioned in a centered rectangular lattice pattern or other pattern that creates an adequate framework to support the top-surface of the composite shingle.

The rib stiffeners can support the body shell and greatly reduce the effective span of the body shell using plate action to reduce shear and bending loads. A reduced effective span allows the body shell thickness to be less, thereby further reducing the material required to make the composite shingle. Additionally, rib stiffeners reduce the unbraced length of the bottom edge of the longitudinal ribs. When the body shell is subjected to an uplift force due to wind loads, the bottom edge of the longitudinal ribs is subjected to compression and the composite shingle is vulnerable to web buckling. The reduced unbraced length of the bottom edge increases the composite shingles resistance to buckling caused by uplift. Further, stiffening the longitudinal ribs allows the longitudinal ribs to be narrower; thus, providing the ability to further reduce the amount of raw material required per shingle.

The composite shingle may also include a nailing zone and/or nailing zone ribs. A nailing zone is generally a recessed portion of the top surface located in the lap portion of body shell. The recessed portion allows a head of a fully driven nail to be below the general bearing plane of the top surface of the shingle. The depressed nailing zone also can visually identify to an installer the proper locations to drive the roofing nails. Further, embodiments of composite shingle 10 use nailing zone ribs integral with the depressed nailing zone. These nailing zone ribs strengthen the area surrounding the nailing zone. The nailing zone is subjected to stress concentrations during installation from the use of pneumatically driven fasteners and throughout the life of the composite shingle from being the anchoring point of the composite shingle. Generally, the nailing zone ribs extend downward from the bottom surface of the body shell in direct proximity to the nailing zone. The nailing zone ribs are generally spaced closer together than the longitudinal ribs, but far enough apart that a fastener body may be driven between the ribs. In addition, the nailing zone rib spacing may be set to prevent a fastener head from passing between two adjacent nailing zone ribs.

An additional embodiment of the composite shingle further comprises alignment aids. Alignment aids may be a laying line, spacing nibs and/or a scale on the top surface. An embodiment of composite shingle includes an alignment aid comprising a laying line. A laying line includes a width that facilitates the application of a second course of composite shingles on top of an underlying course of composite shingles by providing a guide that allows for proper spacing between each of the composite shingles on the second course and ensuring second course is properly aligned with first course. Alternatively, the alignment aid may include at least two spacing nibs. The spacing nibs extend outwardly from the left-side wall, the first side wall, or both side walls. The spacing nibs aid an installer in properly spacing the shingles horizontally when installing composite shingles on the roof. Certain embodiments of the composite shingle include at least two nibs on one side wall. Two spacing nibs on one side wall help square the first shingle in relation to a second shingle horizontally adjacent to it. Additionally, the spacing nibs may be used in concert with the scale located on the top surface of the body shell to help an installer create offset composite shingle patterns or help make sure all the composite shingles have a uniform tab exposure.

A plurality of assembled composite shingles, as presented above, is also claimed as part of this invention. Finally, a method of applying multiple courses of shingles on a roof comprising the steps of providing an underlying shingle, coupling the underlying shingle to the roof, laying an overlying shingle of the type presented above on top of a least a portion of the underlying shingle and coupling the overlapping shingle to the roof.

Further, the method may also include providing a second overlapping shingle as presented above, laying the second overlapping shingle, horizontally proximate to first overlapping shingle, on at least a portion of the underlying shingle wherein the spacing nibs of the second overlapping shingle are in proximate contact with the first overlapping shingle and coupling the second overlapping shingle to the roof.

Additional objects, advantages and novel features of the composite shingle will be set forth in part in the description which follows, and will in part become apparent to those in the practice of the invention, when considered with the attached figures.

DESCRIPTION OF THE SEVERAL VIEWS OF THE DRAWINGS

In the accompanying drawings, which form a part of the specification and are to be read in conjunction therewith in which like reference numerals are used to indicate like or similar parts in the various views.

DETAILED DESCRIPTION OF THE INVENTION

Figure 1:
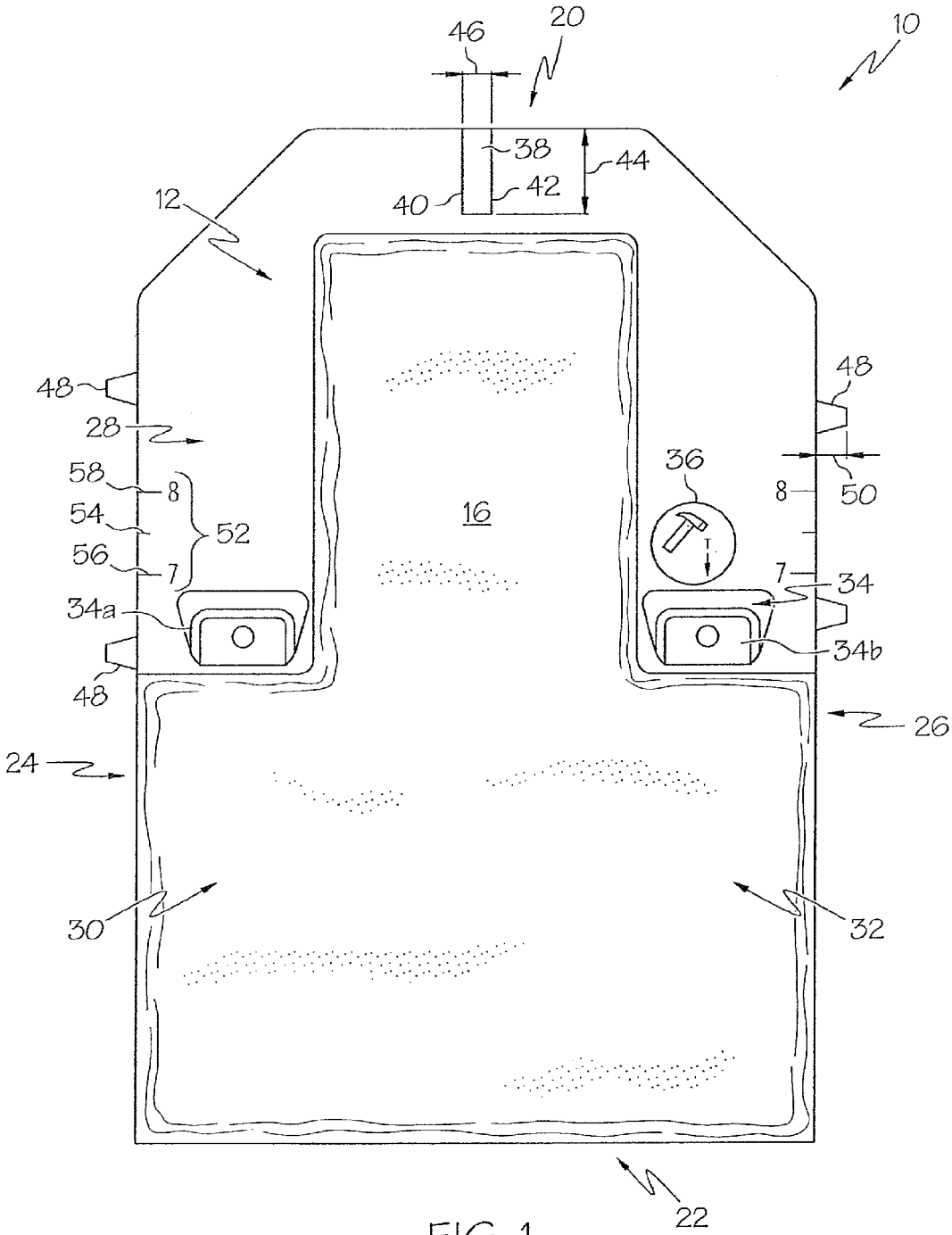
FIG. 1 is a top plan view of a composite shingle according to an embodiment of the composite shingle.

The invention will now be described with reference to the drawing figures, in which like reference numerals refer to like parts throughout. For purposes of clarity in illustrating the characteristics of the present invention, proportional relationships of the elements have not necessarily been maintained in the drawings.

Figure 2:
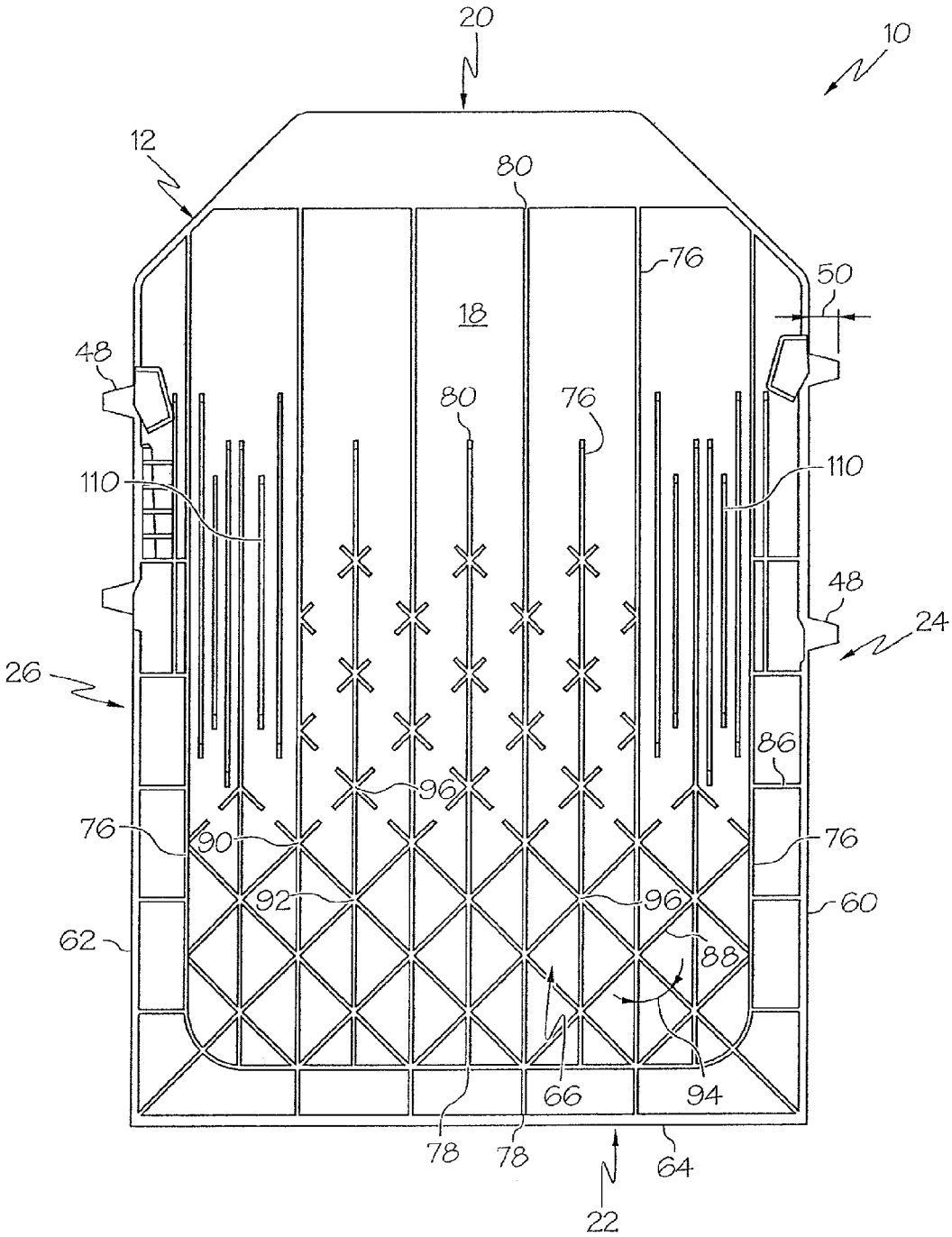
FIG. 2 is a bottom plan view of a composite shingle according to an embodiment of the composite shingle.

Referring now to FIGS. 1 and 2, reference numeral 10 generally denotes a composite shingle. Composite shingle 10 may be formed of any suitable material such as, but not limited to, rubber (e.g., ground up tire rubber), polymers such as polyethylene (e.g., various grades, recycled or virgin), fillers (e.g., wood fibers, glass, stone, limestone), asphalt embedded mats, tile, or any or suitable material. Further, composite shingle 10 may be made and cut, or molded, to any shape desired using known techniques. For example, one manner of making composite shingle 10 is through use of a combination mixer and extruder; however, any method to make composite building materials known in art may be utilized to manufacture composite shingle 10. Natural versions of shingle 10 may also be made of stone, slate, wood, or any other suitable material and may be cut to shape using known techniques.

Shingle 10 generally includes a body shell 12 having a top surface 16, a bottom surface 18, a top end 20, a butt end 22, a first edge 24, and a second edge 26. Further, shell 12 includes a thickness defined as the distance between top surface 16 and bottom surface 18 from about 1/16 inches to about 1 inch or any other thickness suitable for use in the present invention and sufficient to meet applicable industry design standards. It will be appreciated that first and second edges 24, 26 may also be referred to as a right edge or left edge or a leading edge or trailing edge depending on the direction the shingles are being laid on the roof (i.e., right to left or left to right). Top surface 16 generally includes a lap portion 28 and a tab portion 30. In one embodiment, tab portion 30 of top surface 16 includes a textured face 32 configured to resemble either wood shake shingles or slate shingles. Additional embodiments may include texturing tab portion 30 to resemble shingles made of other suitable materials or having a desired aesthetic design. For example, at least a portion of top surface 16 may be textured to resemble slate or wood, and texturing may be accomplished by molding, cutting or otherwise forming one side to simulate natural slate or wood. When an embodiment includes a textured top surface 16, the textured area of top surface 16 may range from just tab portion 30 to the entire top surface 16.

As shown in FIG. 1, shingle 10 may include at least one nailing zone 34 located on top surface 16. Nailing zone 34 is an area in which shingle 10 can be fastened to a roof by a nail, adhesive or any other suitable method or device. Nailing zone 34 is generally positioned on top surface 16 so that shingle 10 will be adequately secured to the roof and also so that nailing zone 34 is covered by an overlying shingle. Nailing zone 34 may a rectangle, a square, a circle or any other shape suitable for use in the present invention. In the embodiment shown, a first nailing zone 34*a* is generally disposed toward the bottom end of tab portion 30 proximate first edge 24 and a second nailing zone 34*b* is generally disposed toward the bottom end of tab portion 30 proximate second edge 26. Nailing zone 34 may be flat or recessed below the common plane of top surface 16 of body shell 12 and is configured to allow for the head of a fully driven nail to be below the general bearing plane of an overlapping shingle. Top surface 16 may also include at least one nail location indicia 36 proximate the top of nailing zone 34 to indicate to an installer where the nail or other suitable fastener should be driven.

In certain embodiments of the present invention, alignment aids such as a laying line 38, at least one spacing nib 48, and at least one scale 52 may be provided anywhere on top surface 16 to facilitate the alignment of an overlying course of composite shingles 10 with respect to an underlying course of shingles 10. Laying line 38, spacing nib 48 and scale 52, as incorporated into the present invention are fully disclosed in U.S. Pat. No. 7,475,516 to Jolitz et al. and U.S. Pat. No. 7,516,593 to Jolitz et al. which are hereby incorporated by reference. In the embodiment shown in FIG. 1, laying line 38 is generally centrally disposed on top surface 16 proximate to top end 20. Laying line 38 may be thin or thick and may be a single line, a pair of lines, or a series of lines: As further illustrated, laying line 38 includes a left edge 40 and a right edge 42 that may also be referred to as a near edge and a far edge depending on the direction the shingles are being laid on the roof. Laying line 38 may extend downwardly from top end 20 to a length 44. A suitable length 44 may be any length that is equal to or less than the entire length of the non-exposed portion of shingle 10. The non-exposed portion is the amount of shingle 10 that is covered by the second course of shingles laid on top thereof. For example, suitable lengths 44 may vary from about 1 to 6 inches or longer depending upon the particular application. It is also within the scope of the present invention to provide a laying line 38 that is slightly raised or elevated from top surface 16 or perhaps colored so as to contrast with the remainder of top surface 16.

Furthermore, laying line 38 has a width 46 that has a thickness sufficient to allow laying line 38 to be at least partially exposed when the edge of an overlying shingle is placed in contacting proximity or aligned with either left or right edge 40, 42. For example, a suitable width 46 for laying line 38 may be at least about ⅛ inches, but it will be understood that other widths such as, but not limited to 3/16 inches, ¼ inches, or ½ inches are also within the scope of the present invention. It will also be understood that the term "exposed" should be interpreted as meaning "visibly exposed" and "non-visibly exposed."

In certain embodiments, composite shingle 10 may also include at least one spacing nib 48 to aid in spacing of shingles and to keep subsequent shingles aligned horizontally aligned with composite shingle 10. As shown in FIG. 1, two spacing nibs 48 outwardly extend from each of first edge 24 and second edge 26. It will be appreciated that shingle 10 may include more than two nibs on each side, a single nib on each side, or no nibs extending from either first or second edge 24, 26. Each of nibs 48 may include an apex having a pointed or a rounded end and extends to a nib width 50. It will be appreciated by those skilled in the art that the widths 50 are preferably equal but different widths are well within the scope of the present invention. Moreover, width 50 may be less than, greater than, or equal to width 46 of laying line 38. Nibs 48 may be spaced apart at generally the same distance on each or first and second edges 24, 26 or nibs 48 on first edge 24 may be staggered lower than nibs 48 located on second edge 26 or vice versa so that nibs 48 extending from first edge 24 would not occupy same position as opposing spacing nibs 48 on second edge 26 of an adjacent composite shingle 10 thereby allowing a course of composite shingles 10 to maintain the desired spacing. Finally, nibs 48 may include thermal expansion relief characteristics as taught in U.S. application Ser. No. 11/463,445 to Shadwell et al. which is hereby incorporated by reference.

In certain embodiments, at least one scale 52 is located on top surface 16 and extends inwardly from each of first and second edges 24, 26. Scale 52 includes a center tick 54, a lower tick 56 positioned below center tick 54, and an upper tick 58 positioned above center tick 54. Each tick may be assigned a number that corresponds to the amount that an underlying shingle will be exposed when the tick mark is aligned with the top end 20 of the underlying shingle. For example, upper tick 58 may be assigned a number "8" that would indicate to an installer that 8 inches or any other unit of measurement of an underlying shingle would be exposed if tick 58 was aligned with the top end 20 of the underlying shingle. Scale 52, alone or in combination with spacing nibs 48, can be used by an installer to ensure a uniform exposure of tab portion 30 or aid in setting a staggered shingle pattern having varying tab portion 30 exposures.

Figure 3:
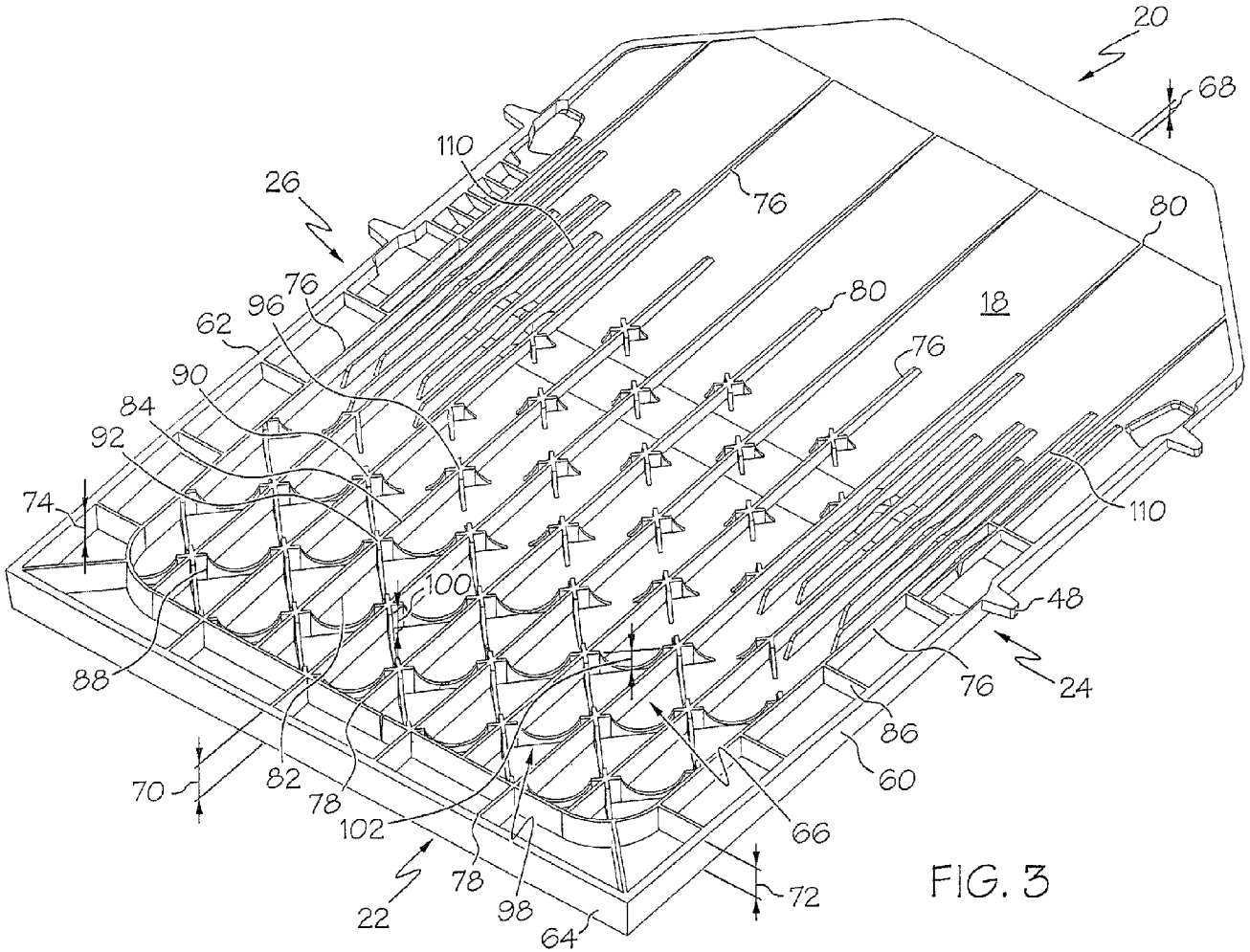
FIG. 3 is a bottom perspective view of a composite shingle according to an embodiment of the composite shingle.

Referring now to FIGS. 2 and 3 (disclosing the bottom surface of the shingle), bottom surface 18 of body shell 12 generally includes top end 20, a first side wall 60 extending along first edge 24, a second side wall 62 extending along second edge 26, and a butt end wall 64 extending along butt end 22. Side walls 60, 62 and butt end wall 64 cooperatively define a cavity 66 and may be textured to match the texture of top surface 16. As shown more clearly in FIG. 3, top end 20 has a top end height 68 approximately equal to the thickness of body shell 12 whereas butt end wall 64 has a butt end height 70 of from about ⅛ inch to about 1.5 inches although any height suitable for a particular use or application may be used. First side wall 60 gradually tapers and decreases in height 72 from butt end 22 to top end 20. Similarly, second side wall 62 also gradually tapers and decreases in height 74 from butt end 22 to top end 20. It will be appreciated that the degree of tapering between first and second side walls 48 and 50 will be generally identical and uniform from butt end 22 to top end 20.

Bottom surface 18 of body shell 12 further includes a plurality of longitudinal ribs 76 most of which extend substantially along the length of the shingle and are configured to support body shell 12 so as to prevent shell 12 from bending or displacing. Longitudinal ribs 76 generally include a first end 78, a second end 80, a top edge 82 and a bottom edge 84 and extend longitudinally from first end 78 located proximate to the butt end 22 to second end 80 located proximate to the top end 20. It will be appreciated that the length and therefore the location of second end 80 of each longitudinal rib 76 may be the same or different and may also be alternately staggered. Longitudinal ribs 76 generally extend downwardly from bottom surface 18 of body shell 12 to a common plane.

In certain embodiments, bottom surface 18 may include transverse ribs 86 generally extending perpendicularly to longitudinal ribs 76. Transverse ribs 86 may be spaced along the length of composite shingle 10 and generally extend from between first side wall 60 and its nearest longitudinal rib 76 and from between second side wall 62 and its nearest longitudinal rib 76. A plurality of x-shaped rib stiffeners 88 are also provided although it will be appreciated that rib stiffeners 88 may be any shape suitable for use in the present invention. Rib stiffeners 88 generally include a first end 90 and a second end 92 and may be integral with longitudinal ribs 76 having an angle of incidence 94 with respect to longitudinal ribs 76 of less than ninety degrees as illustrated in FIG. 2. Further, longitudinal ribs 76 in conjunction with rib stiffeners 88 may be spaced and orientated to create a lattice pattern or any or pattern suitable for use in the present invention. In general, first end 90 of rib stiffener 88 may be integral with a longitudinal rib 76 at an intersection point 96. A plurality of intersection points 96 are spaced along the length of longitudinal rib 76. Second end 92 may be integral with a second longitudinal rib 76 at another intersection point 96 along the length of second longitudinal rib 76. Certain embodiments include rib stiffeners 88 in a centered rectangular lattice pattern. FIG. 3 illustrates one embodiment including rib stiffeners 88 in a centered square lattice pattern wherein the angle of incidence 94 with longitudinal ribs 76 is about forty-five degrees.

Rib stiffener 88 may further include a material saving profile 98 having an end height 100 at intersection point 96 that is greater than a midpoint recess depth 102. Alternatively, rib stiffener 88 may have a constant height over the entire length as plurality of longitudinal ribs 76. The embodiment illustrated in FIG. 3 includes rib stiffeners 88 having a generally arched cross-section. Another embodiment may include a v-shaped stiffener or any shape with a recessed midpoint. In certain embodiments, the amount of exposed top side of each rib stiffener 88 decreases due to a decrease in side wall heights 72, 74 as side walls 60 and 62 taper from butt end 22 to top end 20. In other embodiments, an interrupted rib stiffener may be provided. Interrupted rib stiffener may result from side wall heights 72, 74 not exceeding midpoint recess depth 102 of rib stiffener 88 plus the shingle thickness as heights 72, 74 taper from butt end 22 to top end 20. Alternate embodiments include a rib stiffener 88 with material saving profile wherein midpoint recess depth 102 may be decreased as heights 72, 74 decrease, or alternatively, a rib stiffener 88 may have a uniform profile wherein its height is adjusted proportionately to match that of longitudinal ribs 76 at each intersection point 96.

The spacing between rib stiffeners 88 is dependent on both downward shear force and the thickness of body shell 12 and the uplift force, primarily due to wind loading, that body shell 12 must resist. Rib stiffeners 88 work with body shell 12 and longitudinal ribs 76 to resist force due to both shear and bending. Rib stiffeners 88 allow designers to use less material in body shell 12 and longitudinal ribs 76 because rib stiffeners 88 can be used to reduce shear stress on body shell 12 at top edge 82 of longitudinal rib 76 by reducing the effective span of body shell 12 through plate action. Rib stiffeners 88 can also increase the structural resistance of composite shingle 10 when uplift force causes compression in bottom edge 84 of longitudinal rib 76 by reducing an unbraced length of bottom edge 84. FIGS. 2 and 3 illustrate an embodiment of composite shingle 10 that utilizes a center rectangular lattice pattern having a longitudinal rib spacing of about 1 inch, and a rib stiffener spacing of about 1.4 inches, and an unbraced length of about 2 inches.

FIGS. 2 and 3 also illustrate one embodiment of composite shingle 10 that includes a plurality of nailing zone ribs 110 located between longitudinal ribs 76. Nailing zone ribs 110 generally extend downwardly from bottom surface 18 and located generally beneath nailing zone 34. Concentrated stress forces occur at anchoring locations (the locations where fasteners couple composite shingle 10 to the roof) and nailing zone ribs 110 are configured to reinforce composite shingle 10 at these high stress locations. Alternatively, increasing the strength of composite shingle 10 at anchoring locations could also be achieved by increasing thickness of body shell 12 at these locations. Nailing zone ribs 110 can also be used to reinforce nailing zone 34 so that a pneumatically driven fastener does not shear through body shell 12 of composite shingle 10.

The dimensions of composite shingle 10 may be altered depending at least in part upon the application or design considerations for which composite shingle 10 will be used. For example, composite shingle 10 may be ¼ inches thick, 12 inches wide and 18 inches long.

Figure 4:
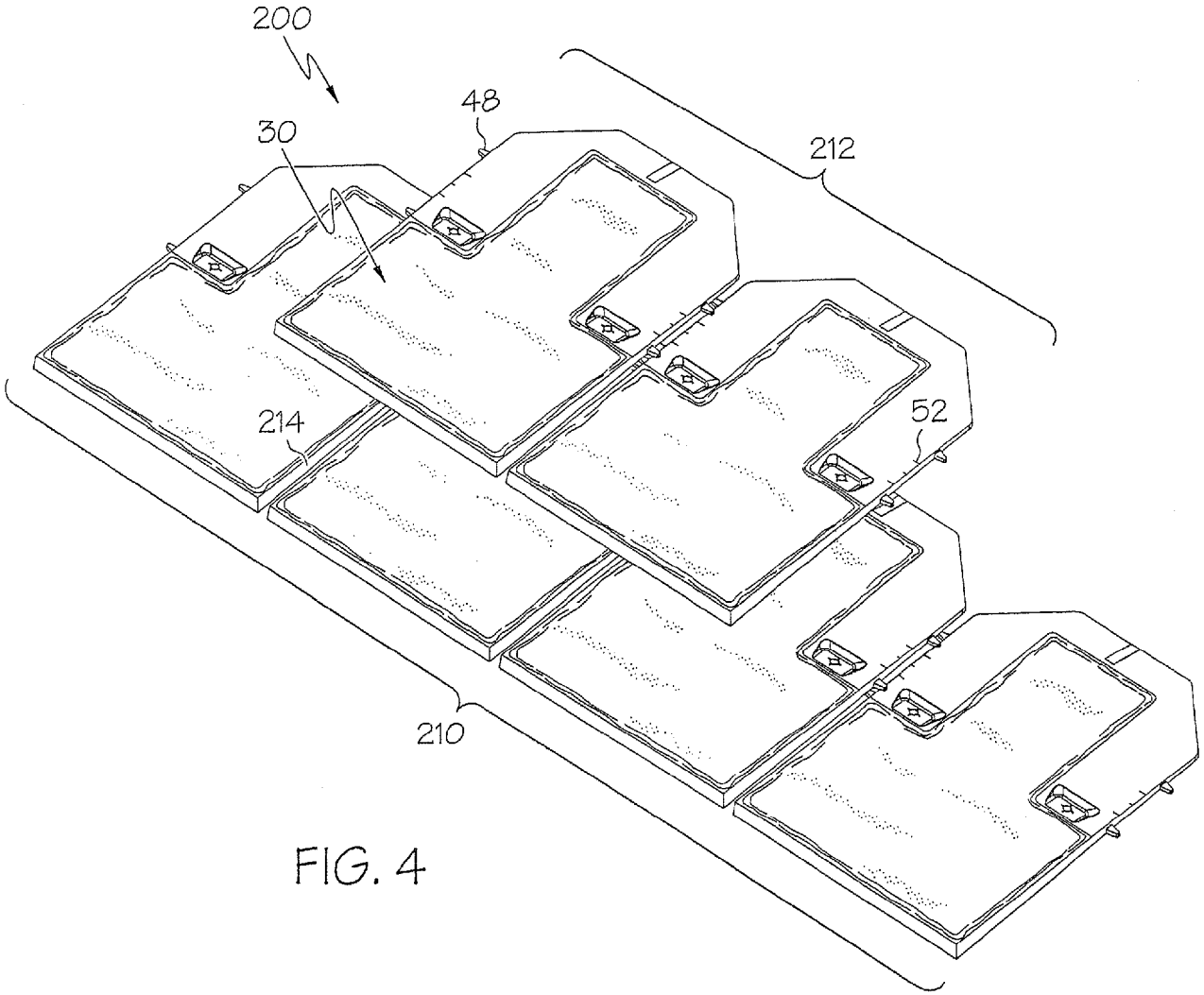
FIG. 4 is a top perspective view of an assembly of composite shingles according to an embodiment of the composite shingle.

A composite shingle 10 constructed in accordance with the present invention may be used to form a roofing system, or at least a portion thereof. Turning now to FIG. 4, an assembly 200 of composite shingles 10 includes a first course 210 and a second course 212 of composite shingles 10 on a roof. Composite shingle 10 can be used to shingle a roof using methods well known in the art including the use of a pneumatic nailing gun to affix composite shingle 10 to the roof. In a typical installation method, a waterproof membrane, such as roofing paper is applied to the roof. Next, composite shingles 10 are installed on the roof beginning with first course 210. Each course consists of laying shingles in horizontal proximity to each other to form a first row. In some embodiments of an assembly of composite shingle 10, spacing nibs 48 and/or laying line 38 are used to uniformly position adjacent composite shingles 10 and help an installer properly align composite shingles 10.

Each composite shingle 10 is then individually coupled to the roof. Typically, composite shingles 10 are coupled to the roof using either hand driven fasteners or pneumatically driven fasteners. One embodiment of the present invention utilizes either hand driven or pneumatic driven roofing nails. Composite shingle 10 should not be limited to being coupled to the roof using roofing nails; however, roofing nails are currently the industry standard. Some embodiments of composite shingle 10 utilize nailing zones 20 to provide a designated area in which an installer should drive a fastener. Additional embodiments provide for nail location indicia 36 on top surface 16 of body shell 12 to specifically identify the point on composite shingle 10 where a fastener should be driven. Each shingle should be coupled to the roof with at least two fasteners.

When first course 210 has progressed, then second course 212 may be started. Second course 212 positions tab portion 30 of composite shingle 10 overlapping lap portion 28 of first course 210 of composite shingles 10. In addition, second course 212 of composite shingles 10 are horizontally staggered such that vertical joint 214 between two adjacent composite shingles 10 on first course 210 is overlapped by tab portion 30 of composite shingle 10 of second course 212. The placement of composite shingle 10 repeats in the same manner for the entire roof. An alternative embodiment includes using alignment aids such as a laying line 38, spacing nibs 48 and scale 52 that facilitates the application of second course 212 of composite shingles 10 on top of first course 210 of shingles by providing a guide that allows for proper spacing between each composite shingle 10 on second course 212 and ensuring second course 212 is properly aligned with first course 210. FIG. 4 illustrates an exemplary partial layout of first course 210 and second course 212 of composite shingle 10. Subsequent courses are laid until the entire roof is covered. When composite shingles 10 have reached the uppermost point of the roof or a change in roof plane, any number of specially formed hip or ridge members are used at any transition in the roof plane to complete composite shingle 10 installation.

While particular embodiments of the invention have been shown, it will be understood, of course, that the invention is not limited thereto, since modifications may be made by those skilled in the art, particularly in light of the foregoing teachings. Reasonable variation and modification are possible within the scope of the foregoing disclosure of the invention without departing from the spirit of the invention.

We claim:

1. A composite shingle of unitary construction comprising:
- a body shell including a top surface, a bottom surface, a top end, a butt end wall, a first side wall, a second side wall, a lap portion, and a tab portion;
- a plurality of longitudinal ribs extending downward from said bottom surface of said body shell to a common plane;
- a plurality of rib stiffeners with a first end and a second end and extending downward from said bottom surface wherein said first end and said second end are formed as a unit with and are connected to said longitudinal ribs and wherein said plurality of rib stiffeners include a material saving profile, wherein said material saving profile includes a midpoint recess depth greater than zero.

2. The composite shingle of claim 1 wherein said plurality of rib stiffeners are orientated in a centered rectangular lattice pattern.

3. The composite shingle of claim 1 wherein said material saving profile is an arched profile.

4. The composite shingle of claim 1 further comprising an alignment aid comprising at least two spacing nibs, a scale, and a laying line.

5. The composite shingle of claim 1 wherein at least said tab portion of said top surface of said body shell is textured to resemble a natural material selected from a group consisting of slate and wood.

6. The composite shingle of claim 1 wherein at least a portion of said butt end wall, said first side wall and said second side wall are textured to resemble a natural material selected from a group consisting of slate and wood.

7. The composite shingle of claim 1 further comprising at least one nailing zone identified on said top surface, said at least one nailing zone being a recessed portion of said top surface.

8. The composite shingle of claim 7 further comprising a plurality of nailing zone ribs extending downward from said bottom surface of said body shell, said plurality of nailing zone ribs positioned substantially beneath said at least one nailing zone and between said longitudinal ribs wherein said plurality of nailing zone ribs have a rib-to-rib spacing less than a rib-to-rib spacing of said longitudinal ribs.

9. A composite shingle of unitary construction comprising:
- a body shell including a top surface, a bottom surface, a top end, a butt end wall, a first side wall, a second side wall, a lap portion, and a tab portion;
- a plurality of longitudinal ribs extending downward from said bottom surface of said body shell to a common plane;
- a plurality of rib stiffeners with a first end and a second end and extending downward from said bottom surface wherein said first end and said second end are formed as a unit with and are connected to said longitudinal ribs;
- at least one nailing zone identified on said top surface; and
- a plurality of nailing zone ribs extending downward from said bottom surface of said body shell, said plurality of nailing zone ribs being substantially beneath said at least one nailing zone and between said longitudinal ribs, and wherein said plurality of nailing zone ribs have a rib-to-rib spacing less than a rib-to-rib spacing of said longitudinal ribs.

10. The composite shingle of claim 9 wherein said at least one nailing zone is a recessed portion of said top surface.

11. The composite shingle of claim 9 further comprising an alignment aid comprising at least two spacing nibs, a scale, and a laying line.

12. The composite shingle of claim 9 wherein at least said tab portion of said top surface of said body shell is textured to resemble a natural material selected from a group consisting of slate and wood.

13. The composite shingle of claim 9 wherein at least a portion of said butt end wall, said first side wall and said second side wall are textured to resemble a natural material selected from a group consisting of slate and wood.

14. The composite shingle of claim 9 wherein said plurality of rib stiffeners are orientated in a centered rectangular lattice pattern.

15. A method of applying multiple courses of composite shingles on a roof comprising:
- providing an underlying shingle;
- coupling said underlying shingle to said roof to form at least a portion of a first course;
- laying a first overlying shingle on at least a portion of said underlying shingle said first overlying shingle having a unitary construction and including:
  - a body shell including a top surface, a bottom surface, a top end, a butt end wall, a first side wall, a second side wall, a lap portion, and a tab portion;
  - a plurality of longitudinal ribs extending downward from said bottom surface of said body shell to a common plane;
  - a plurality of rib stiffeners with a first end and a second, end and extending downward from said bottom surface wherein said first end and said second end are formed as a unit with and are connected to said longitudinal ribs and wherein said plurality of rib stiffeners include a material saving profile, wherein said material saving profile includes a midpoint recess depth greater than zero; and
- coupling said first overlying shingle to said roof.

16. The method of claim 15 wherein at least said tab portion of said top surface of said body shell of said first overlying shingle is textured to resemble a natural material selected from a group consisting of slate and wood.

17. A method of applying multiple courses of composite shingles on a roof comprising:

providing an underlying shingle;

coupling said underlying shingle to said roof to form at least a portion of a first course;

laying a first overlying shingle on at least a portion of said underlying shingle said first overlying shingle having a unitary construction and including:

a body shell including a top surface, a bottom surface, a top end, a butt end wall, a first side wall, a second side wall, a lap portion, and a tab portion;

a plurality of longitudinal ribs extending downward from said bottom surface of said body shell to a common plane;

a plurality of rib stiffeners with a first end and a second end and extending downward from said bottom surface wherein said first end and said second end are formed as a unit with and are connected to said longitudinal ribs;

at least one nailing zone identified on said top surface wherein said nailing zone is a recessed portion of said top surface; and a plurality of nailing zone ribs extending downward from said bottom surface of said body shell, said plurality of nailing zone ribs being substantially beneath said at least one nailing zone and between said longitudinal ribs, and wherein said plurality of nailing zone ribs have a rib-to-rib spacing less than a rib-to-rib spacing of said longitudinal ribs; and coupling said first overlying shingle to said roof.

18. The method of claim 17 wherein at least tab portion of said top surface of said body shell of said first overlying shingle is textured to resemble a natural material selected from a group consisting of slate and wood.

* * * * *